US007734383B2

(12) United States Patent
Philp et al.

(10) Patent No.: US 7,734,383 B2
(45) Date of Patent: Jun. 8, 2010

(54) METHOD AND APPARATUS FOR PLANNING THE MOVEMENT OF TRAINS USING DYNAMIC ANALYSIS

(75) Inventors: Joseph Wesley Philp, Indialantic, FL (US); Mitchell Scott Wills, Melbourne, FL (US); Joanne Maceo, Rockledge, FL (US); Joel Kickbusch, Rockledge, FL (US); Randall Markley, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 906 days.

(21) Appl. No.: 11/415,275

(22) Filed: May 2, 2006

(65) Prior Publication Data

US 2007/0260369 A1 Nov. 8, 2007

(51) Int. Cl.
*G05D 1/00* (2006.01)

(52) U.S. Cl. ..... 701/19; 246/2 R

(58) Field of Classification Search ..... 701/19, 701/20, 117, 204; 246/122 R, 167 R, 2 R; 705/8

See application file for complete search history.

(56) References Cited

U.S. PATENT DOCUMENTS

| | | | |
|---|---|---|---|
| 3,575,594 | A | 4/1971 | Elcan |
| 3,734,433 | A | 5/1973 | Metzner |
| 3,794,834 | A | 2/1974 | Auer, Jr. et al. |
| 3,839,964 | A | 10/1974 | Gayot |
| 3,895,584 | A | 7/1975 | Paddison |
| 3,944,986 | A | 3/1976 | Staples |
| 4,099,707 | A | 7/1978 | Anderson |
| 4,122,523 | A | 10/1978 | Morse et al. |
| 4,361,300 | A | 11/1982 | Rush |
| 4,361,301 | A | 11/1982 | Rush |
| 4,610,206 | A | 9/1986 | Kubala et al. |
| 4,669,047 | A | 5/1987 | Chucta |
| 4,791,871 | A | 12/1988 | Mowll |
| 4,843,575 | A | 6/1989 | Crane |
| 4,883,245 | A | 11/1989 | Erickson, Jr. |
| 4,926,343 | A | 5/1990 | Tsuruta et al. |
| 4,937,743 | A | 6/1990 | Rassman et al. |
| 5,038,290 | A | 8/1991 | Minami |
| 5,063,506 | A | 11/1991 | Brockwell et al. |
| 5,177,684 | A | 1/1993 | Harker et al. |
| 5,222,192 | A | 6/1993 | Shafer |
| 5,229,948 | A | 7/1993 | Wei et al. |

(Continued)

FOREIGN PATENT DOCUMENTS

| | | |
|---|---|---|
| CA | 2057039 | 12/1990 |

(Continued)

OTHER PUBLICATIONS

Crone, et al., "Distributed Intelligent Network Management for the SDI Ground Network," IEEE, 1991, pp. 722-726, MILCOM '91.

(Continued)

*Primary Examiner*—Dalena Tran
(74) *Attorney, Agent, or Firm*—Duane Morris LLP

(57) ABSTRACT

A method of planning the movement of plural trains through a rail network using a database of dynamic planning attributes reflecting the current conditions of the train and rail network.

9 Claims, 1 Drawing Sheet

U.S. PATENT DOCUMENTS

| | | | | |
|---|---|---|---|---|
| 5,237,497 | A | | 8/1993 | Sitarski |
| 5,265,006 | A | | 11/1993 | Asthana et al. |
| 5,289,563 | A | | 2/1994 | Nomoto et al. |
| 5,311,438 | A | | 5/1994 | Sellers et al. |
| 5,331,545 | A | | 7/1994 | Yajima et al. |
| 5,332,180 | A | | 7/1994 | Peterson et al. |
| 5,335,180 | A | | 8/1994 | Takahashi et al. |
| 5,365,516 | A | | 11/1994 | Jandrell |
| 5,390,880 | A | | 2/1995 | Fukawa et al. |
| 5,420,883 | A | | 5/1995 | Swensen et al. |
| 5,437,422 | A | | 8/1995 | Newman |
| 5,463,552 | A | | 10/1995 | Wilson et al. |
| 5,467,268 | A | | 11/1995 | Sisley et al. |
| 5,487,516 | A | | 1/1996 | Murata et al. |
| 5,541,848 | A | | 7/1996 | McCormack et al. |
| 5,623,413 | A | | 4/1997 | Matheson et al. |
| 5,625,559 | A | * | 4/1997 | Egawa ..... 701/117 |
| 5,745,735 | A | | 4/1998 | Cohn et al. |
| 5,794,172 | A | | 8/1998 | Matheson et al. |
| 5,823,481 | A | | 10/1998 | Gottschlich |
| 5,825,660 | A | | 10/1998 | Cagan et al. |
| 5,828,979 | A | | 10/1998 | Polivka et al. |
| 5,836,529 | A | * | 11/1998 | Gibbs ..... 246/122 R |
| 5,850,617 | A | | 12/1998 | Libby |
| 6,032,905 | A | | 3/2000 | Haynie |
| 6,115,700 | A | | 9/2000 | Ferkinhoff et al. |
| 6,125,311 | A | | 9/2000 | Lo |
| 6,144,901 | A | | 11/2000 | Nickles et al. |
| 6,154,735 | A | | 11/2000 | Crone |
| 6,250,590 | B1 | | 6/2001 | Hofestadt et al. |
| 6,351,697 | B1 | | 2/2002 | Baker |
| 6,377,877 | B1 | | 4/2002 | Doner |
| 6,393,362 | B1 | | 5/2002 | Burns |
| 6,405,186 | B1 | | 6/2002 | Fabre et al. |
| 6,459,965 | B1 | | 10/2002 | Polivka et al. |
| 6,587,764 | B2 | | 7/2003 | Nickles et al. |
| 6,637,703 | B2 | | 10/2003 | Matheson et al. |
| 6,654,682 | B2 | | 11/2003 | Kane et al. |
| 6,766,228 | B2 | | 7/2004 | Chirescu |
| 6,789,005 | B2 | | 9/2004 | Hawthorne |
| 6,799,097 | B2 | | 9/2004 | Antelo |
| 6,799,100 | B2 | | 9/2004 | Burns |
| 6,853,889 | B2 | | 2/2005 | Cole |
| 6,856,865 | B2 | | 2/2005 | Hawthorne |
| 7,006,796 | B1 | | 2/2006 | Hofmann et al. |
| 2003/0105561 | A1 | | 6/2003 | Nickles et al. |
| 2003/0183729 | A1 | | 10/2003 | Root et al. |
| 2004/0010432 | A1 | | 1/2004 | Matheson et al. |
| 2004/0034556 | A1 | | 2/2004 | Matheson et al. |
| 2004/0093196 | A1 | | 5/2004 | Hawthorne |
| 2004/0093245 | A1 | | 5/2004 | Matheson et al. |
| 2004/0267415 | A1 | | 12/2004 | Lacote et al. |
| 2005/0107890 | A1 | | 5/2005 | Minkowitz et al. |
| 2005/0192720 | A1 | | 9/2005 | Christie et al. |
| 2006/0074544 | A1 | | 4/2006 | Morariu et al. |

FOREIGN PATENT DOCUMENTS

| | | |
|---|---|---|
| CA | 2066739 | 2/1992 |
| CA | 2046984 | 6/1992 |
| CA | 2112302 | 6/1994 |
| CA | 2158355 | 10/1994 |
| EP | 0108363 | 5/1984 |
| EP | 0193207 | 9/1986 |
| EP | 0341826 | 11/1989 |
| EP | 0554983 | 8/1993 |
| FR | 2692542 | 12/1993 |
| GB | 1321053 | 6/1973 |
| GB | 1321054 | 6/1973 |
| JP | 3213459 | 9/1991 |
| WO | WO 90/03622 | 4/1990 |
| WO | WO 93/15946 | 8/1993 |

OTHER PUBLICATIONS

Ghedira, "Distributed Simulated Re-Annealing for Dynamic Constraint Satisfaction Problems," IEEE 1994, pp. 601-607.

Hasselfield, et al., "An Automated Method for Least Cost Distribution Planning," IEEE Transactions on Power Delivery, vol. 5, No. 2, Apr. 1990, 1188-1194.

Herault, et al., "Figure-Ground Discrimination: A Combinatorial Optimization Approach," IEEE Transactions on Pattern Analysis & Machine Intelligence, vol. 15, No. 9, Sep. 1993, 899-914.

Igarashi, "An Estimation of Parameters in an Energy Fen Used in a Simulated Annealing Method," IEEE, 1992, pp. IV-180-IV-485.

Komaya, "A New Simulation Method and its Application to Knowledge-based Systems for Railway Scheduling," May 1991, pp. 59-66.

Puget, "Object Oriented Constraint Programming for Transportation Problems," IEEE 1993, pp. 1-13.

Sasaki, et al., "Development for a New Electronic Blocking System," QR of RTRI, vol. 30, No. 4, Nov. 1989, pp. 198-201.

Scherer, et al., "Combinatorial Optimization for Spacecraft Scheduling," 1992 IEEE International Conference on Tolls with AI, Nov. 1992, pp. 120-126.

Watanabe, et al., "Moving Block System with Continuous Train Detection Utilizing Train Shunting Impedance of Track Circuit," QR of RTRI, vol. 30, No. 4, Nov. 1989, pp. 190-197.

* cited by examiner

METHOD AND APPARATUS FOR PLANNING THE MOVEMENT OF TRAINS USING DYNAMIC ANALYSIS

RELATED APPLICATIONS

The present application is being filed concurrently with the following related applications, each of which is commonly owned:

Application Ser. No. 11/415,273 entitled "Method of Planning Train Movement Using a Front End Cost Function";

Application Ser. No. 11/415,274 entitled "Method and Apparatus for Planning Linked Train Movements"; and Application Ser. No. 11/415,272 entitled "Method of Planning the Movement of Trains Using Route Protection."

The disclosure of each of the above referenced applications are hereby incorporated herein by reference.

BACKGROUND OF THE INVENTION

The present invention relates to the scheduling of movement of plural units through a complex movement defining system, and in the embodiment disclosed, to the scheduling of the movement of freight trains over a railroad system, and specifically to the managing the dynamic properties of the plan.

Systems and methods for scheduling the movement of trains over a rail network have been described in U.S. Pat. Nos. 6,154,735, 5,794,172, and 5,623,413, the disclosure of which is hereby incorporated by reference.

As disclosed in the referenced patents and applications, the complete disclosure of which is hereby incorporated herein by reference, railroads consist of three primary components (1) a rail infrastructure, including track, switches, a communications system and a control system; (2) rolling stock, including locomotives and cars; and, (3) personnel (or crew) that operate and maintain the railway. Generally, each of these components are employed by the use of a high level schedule which assigns people, locomotives, and cars to the various sections of track and allows them to move over that track in a manner that avoids collisions and permits the railway system to deliver goods to various destinations.

As disclosed in the referenced patents and applications, a precision control system includes the use of an optimizing scheduler that will schedule all aspects of the rail system, taking into account the laws of physics, the policies of the railroad, the work rules of the personnel, the actual contractual terms of the contracts to the various customers and any boundary conditions or constraints which govern the possible solution or schedule such as passenger traffic, hours of operation of some of the facilities, track maintenance, work rules, etc. The combination of boundary conditions together with a figure of merit for each activity will result in a schedule which maximizes some figure of merit such as overall system cost.

As disclosed in the referenced patents and applications, and upon determining a schedule, a movement plan may be created using the very fine grain structure necessary to actually control the movement of the train. Such fine grain structure may include assignment of personnel by name as well as the assignment of specific locomotives by number, and may include the determination of the precise time or distance over time for the movement of the trains across the rail network and all the details of train handling, power levels, curves, grades, track topography, wind and weather conditions. This movement plan may be used to guide the manual dispatching of trains and controlling of track forces, or provided to the locomotives so that it can be implemented by the engineer or automatically by switchable actuation on the locomotive.

The planning system is hierarchical in nature in which the problem is abstracted to a relatively high level for the initial optimization process, and then the resulting course solution is mapped to a less abstract lower level for further optimization. Statistical processing is used at all levels to minimize the total computational load, making the overall process computationally feasible to implement. An expert system is used as a manager over these processes, and the expert system is also the tool by which various boundary conditions and constraints for the solution set are established. The use of an expert system in this capacity permits the user to supply the rules to be placed in the solution process.

Currently, a dispatcher's view of the controlled railroad territory can be considered myopic. Dispatcher's view and processes information only within their own control territories and have little or no insight into the operation of adjoining territories, or the railroad network as a whole. Current dispatch systems simply implement controls as a result of the individual dispatcher's decisions on small portions of the railroad network and the dispatchers are expected to resolve conflicts between movements of objects on the track (e.g. trains, maintenance vehicles, survey vehicles, etc.) and the available track resource limitations (e.g. limited number of tracks, tracks out of service, consideration of safety of maintenance crews near active tracks) as they occur, with little advanced insight or warning.

A train schedule is an approximate strategic forecast for a train provided by a customer for the desired movements of trains. The train schedule may be made days, weeks or months in advance. The actual train behavior is a function of many factors, such as (a) work to be performed along the route, (b) consist-based constraints (e.g., height, width, weight, speed, hazmat and routing restrictions), (c) re-crew requirements, and (d) the physics of the train and locomotive consist. These factors vary from day to day and for the same train along its route.

The movement plan for trains cannot be accurate in the absence of this information, which is available to the railroad, but is generally not available in sufficient detail for the movement planner. If the movement planner is not provided with the needed information, including dynamic variation in time and route, train movement will be planned and auto routed in a manner inconsistent with the then-current conditions. For example, if a block is placed in front of a train and the movement planner has not received this information, the movement plan may route the train to a location it cannot advance out of.

Typically, prior art movement planners calculate movement plans from static train schedules and fixed train priorities. Train characteristics are not forecast at all points along the planned route; instead the plan is typically based on default characteristics, characteristics applicable at the current location of the train, or characteristics assumed upon terminal departures. Line of the road and terminal attributes are treated as constant throughout the planning process to simply the complexity of the scheduling problem, and due to a lack of coordination in data collection from the railroad, dispatcher and filed sensors.

The present disclosure provides a database of train characteristics derived from the railroad's management information systems, field sensors and dispatch input to provide an improved movement plan that reflects the most current characteristics of the train and attributes of the line or road.

These and many other objects and advantages of the present invention will be readily apparent to one skilled in the art to which the invention pertains from a perusal of the claims, the appended drawings, and the following detailed description of the embodiments.

DETAILED DESCRIPTION

Figure 1:
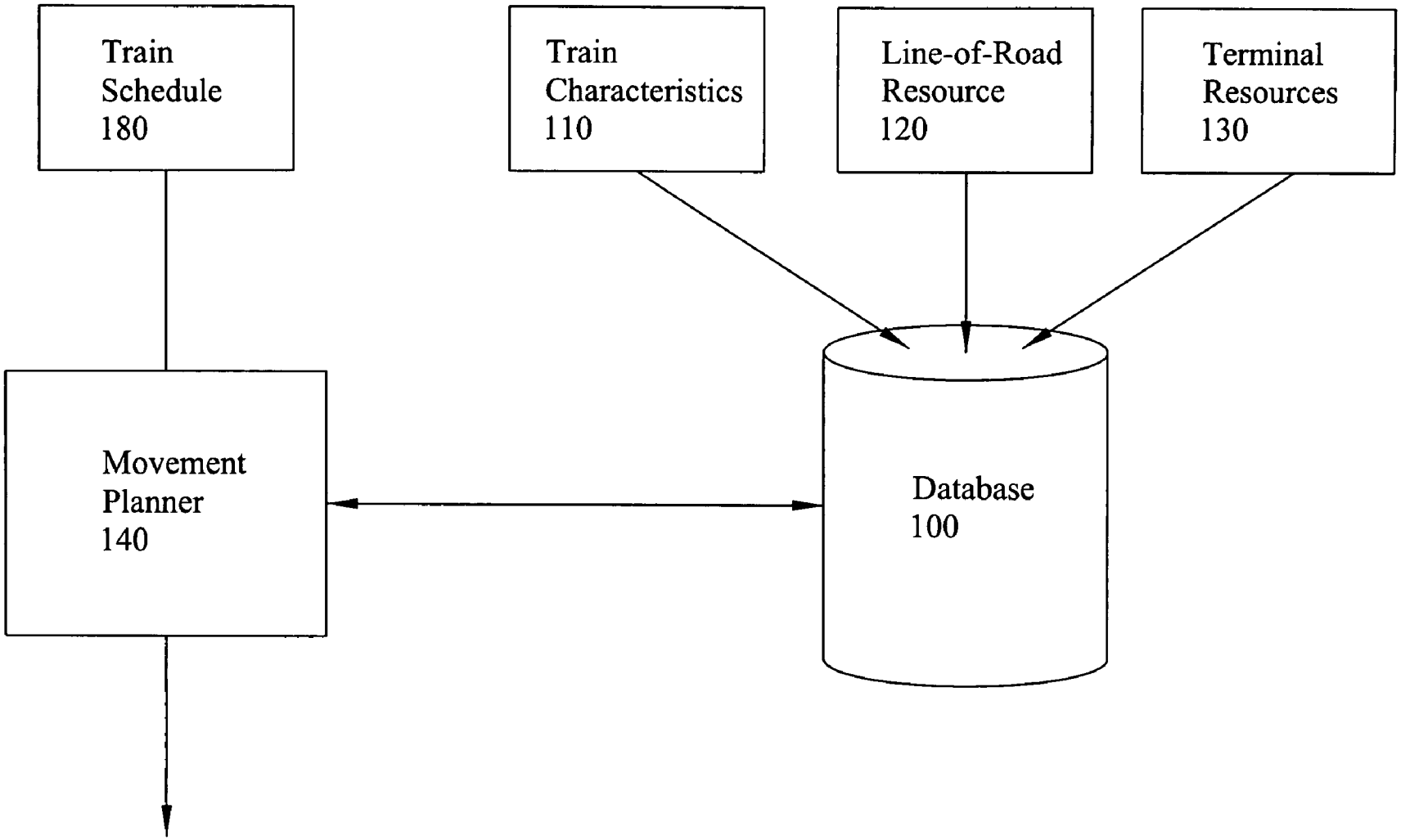
FIG. 1 is a simplified functional representation of an embodiment of planning the movement of trains using dynamic analysis.

FIG. 1 illustrates a database 100 which includes input from the railroad's management information system, field sensors, and dispatch input to provide planning attributes. The planning attributes may include train characteristics 110, line-of-road resources 120 and terminal resources 130. The database 100 may include (a) trip plan including route requirements and activities for each train, (b) locomotive consist, describing the characteristics and on train and off-train location of each current and future locomotive, (c) pick-up and set out locations, (d) consist constraints such as speed, height, width, weight, hazmat and special handling need as a function of location along planned route, (e) consist summaries along the planned route (loads, empties, tonnage and length), and (f) crew information, including on-train and off-train locations and service expiration times. The integrated database 100 automatically provides accurate information to the movement planner without additional attention from the dispatcher. The movement planner my use well known optimizing techniques including those disclosed in the referenced patents and applications. Train schedule 150 is supplied by the railroad and an optimized movement plan is generated by movement planner 140 based on the most current train characteristics, line of road resources and terminal resources from database 100.

Detailed train activity information such as activity duration, specific work locations and alternate work locations are automatically monitored from day to day, updating the activity profiles in the database. In this manner, the accuracy of the planning information is continuously improved and manual intervention which was typically required in prior art systems is eliminated. In one embodiment, the information can be based on historical performance, and appropriate averaging and weighting can be used to emphasize some measured samples based on temporal or priority constraints.

The information in the database can be forecast for each point along the route. For example, the train attributes of length, hazmat content, high/wide restrictions, horsepower, speed, stopping distance and acceleration may be dynamically altered along the route as cars and locomotives are picked up and set off. The train movement plan is based on the forecasted attributes at each point along the route. Thus changes in the train consist; specified route or track constraint anywhere along the planned route can be immediately identified and can cause the movement plan to be revised to take the most current conditions into account.

In another embodiment, the dynamic planning database can be monitored and upon the detection of a change to a planning attribute contained in the database, auto-routing of a train can be disabled until the movement planner has had time to revise the movement planner consistent with the updated planning attributes.

Thus, at each time within the planning horizon, the movement planner can apply the expected attributes of trains, line of road resources and terminal applicable at that time. If any of the data changes, the movement plan can revise the movement order based on the updated data. Train characteristics can include locomotive consist forecast, train consist forecast, crew expiration forecast, current train location upon plan calculation, expected dwell time at activity locations and train value variation along the route. The line of road resources may include reservations for maintenance of way effective and expiration time, form-based authority expiration time, bulletin item effective and expiration time and track curfew effective and expiration time. Terminal resources may include work locations, interactions with other trains, and available tracks.

In the present disclosure, movement plans are enhanced because the train characteristics and planning data are correctly accounted for as they change along the planned route. The methods of maintaining the database of dynamic planning attributes and planning the movement of trains using the current planning attributes can be implemented using computer usable medium having a computer readable code executed by special purpose or general purpose computers.

While embodiments of the present invention have been described, it is understood that the embodiments described are illustrative only and the scope of the invention is to be defined solely by the appended claims when accorded a full range of equivalence, many variations and modifications naturally occurring to those of skill in the art from a perusal hereof.

What is claimed:

1. A method of planning the movement of trains over a rail network, comprising:

(a) receiving a schedule for the planned movement of a train along a route;

(b) monitoring and accessing a database including current train characteristics selected from the group of train length, hazmat content, high/wide restrictions, horsepower, speed, stopping distance, acceleration, and combinations thereof;

(c) detecting a change to any train characteristic in the database;

(d) predicting a train characteristic of the train at plural locations along the route as a function of the detection of the change; and (e) planning the movement of the train as a function of the predicted train characteristic at ones of the plural locations along the route.

2. The method of claim 1 wherein the information contained in the database is derived from historical performance.

3. The method of claim 1 further comprising the steps of:

(f) disabling autorouting of the train as a function of the detection of a change to a planning attribute.

4. The method of claim 1 further including the step of updating the database with information received from a field sensor.

5. A method of planning the movement of trains over a rail network, comprising:

(a) receiving a schedule for the planned movement of a train along a route;

(b) maintaining a database of train characteristics;

(c) planning the movement of the train as a function of the train characteristics;

(d) updating the database with information received from a railroad management information system;

(e) monitoring the database to detect a change to any train characteristic;

(f) predicting a train characteristic of the train at plural locations along the route as a function of the detected change; and (g) planning the movement of the train as a function of the predicted train characteristic at ones of the plural locations along the route.

6. The method of claim 5 wherein the train characteristics are selected from the group of train length, hazmat content, high/wide restrictions, horsepower, speed, stopping distance, acceleration, and combinations thereof.

7. The method of claim 5 wherein information received from a railroad's management information system includes information received from a field sensor.

8. A computer readable storage medium storing a program for controlling the movement of plural trains over a rail network, the computer program comprising:

a computer usable medium having computer readable program code modules embodied in said medium for planning the movement of trains;

a computer readable first program code module for receiving a schedule for the planned movement of a train along a route;

a computer readable second program code module for monitoring and accessing a database including current train characteristics selected from the group of train length, hazmat content, high/wide restrictions, horsepower, speed, stopping distance, acceleration, and combinations thereof;

a computer readable third program code module for detecting a change to any train characteristic in the database;

a computer readable fourth program code module for predicting a train characteristic of the train at plural locations along the route as a function of the detection of the change; and a computer readable fifth program code module for planning the movement of the train as a function of the predicted train characteristic at ones of the plural locations along the route.

9. The computer program of claim 8 further comprising a computer readable sixth program code module for updating the database with information received from a railroad management information system.

* * * * *